US006618236B1

(12) United States Patent
Tsuwako et al.

(10) Patent No.: US 6,618,236 B1
(45) Date of Patent: Sep. 9, 2003

(54) MAGNETIC HEAD HANDLING GLOVE

(75) Inventors: Kazushi Tsuwako, Machida (JP); Yasuhiro Sasao, Sagamihara (JP); Katsushi Yamaguchi, Honfujisawa (JP); Hirokazu Yamamoto, Yamato (JP)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/607,583

(22) Filed: Jun. 29, 2000

(30) Foreign Application Priority Data

Jun. 29, 1999 (JP) ..... 11-183141

(51) Int. Cl.[7] ..... H05E 3/00; A41D 19/00
(52) U.S. Cl. ..... 361/220; 2/167
(58) Field of Search ..... 361/212, 220, 361/225; 2/161.6, 167

(56) References Cited

U.S. PATENT DOCUMENTS

| | | | | |
|---|---|---|---|---|
| 3,596,134 A | | 7/1971 | Burke | |
| 4,660,228 A | | 4/1987 | Ogawa et al. | 2/167 |
| 4,769,856 A | * | 9/1988 | Reed | 2/167 |
| 4,992,335 A | | 2/1991 | Guerra et al. | 428/518 |
| 5,704,066 A | | 1/1998 | Yamamoto | 2/161.6 |
| 5,723,186 A | | 3/1998 | Fraser, Jr. | 427/430.1 |
| 5,736,469 A | | 4/1998 | Bhattacharjee et al. | 442/110 |
| 5,855,301 A | | 1/1999 | Mykkanen et al. | 222/192 |
| 6,008,979 A | | 12/1999 | Mykkanen et al. | 361/220 |
| 6,060,986 A | * | 5/2000 | Lederer | 340/540 |
| RE37,430 E | * | 10/2001 | Toon | 428/377 |
| 6,338,162 B1 | * | 1/2002 | Geng | 2/161.6 |

FOREIGN PATENT DOCUMENTS

| | | | |
|---|---|---|---|
| JP | A-51-131584 | 11/1976 | B29H/9/06 |
| JP | 64-14120 U | 1/1989 | A41D/19/00 |
| JP | 7-9926 U | 2/1995 | A41D/13/10 |

OTHER PUBLICATIONS

IBM Technical disclosure Bulletin, vol. 19, No. 6, Nov. 1976.

* cited by examiner

*Primary Examiner*—Adolf D. Berhane
(74) *Attorney, Agent, or Firm*—William D. Gill; Lewis L. Nunnelley

(57) ABSTRACT

A magnetic head handling glove capable of preventing the buildup of static charges and electric charge leakage and capable of withstanding use in clean rooms is described. In the magnetic head handling glove 1 of the present invention, the outer surface alone or both the outer surface and inner surface of a conductive glove 2 are coated with dissipative material 3,4. This results in coating of the conductive glove with materials useable in clean rooms and may suppress possible contamination that can result when a conventional conductive glove, lacking in such coating of dissipative material, is used directly in a clean room. Besides this, the conductive glove 2 is configured to be grounded directly with wire 5. In this way, even an operator prone to the buildup of static charges can be sufficiently prevented from building up static electrical charges and electric charge leakage.

20 Claims, 2 Drawing Sheets

[Figure 1]
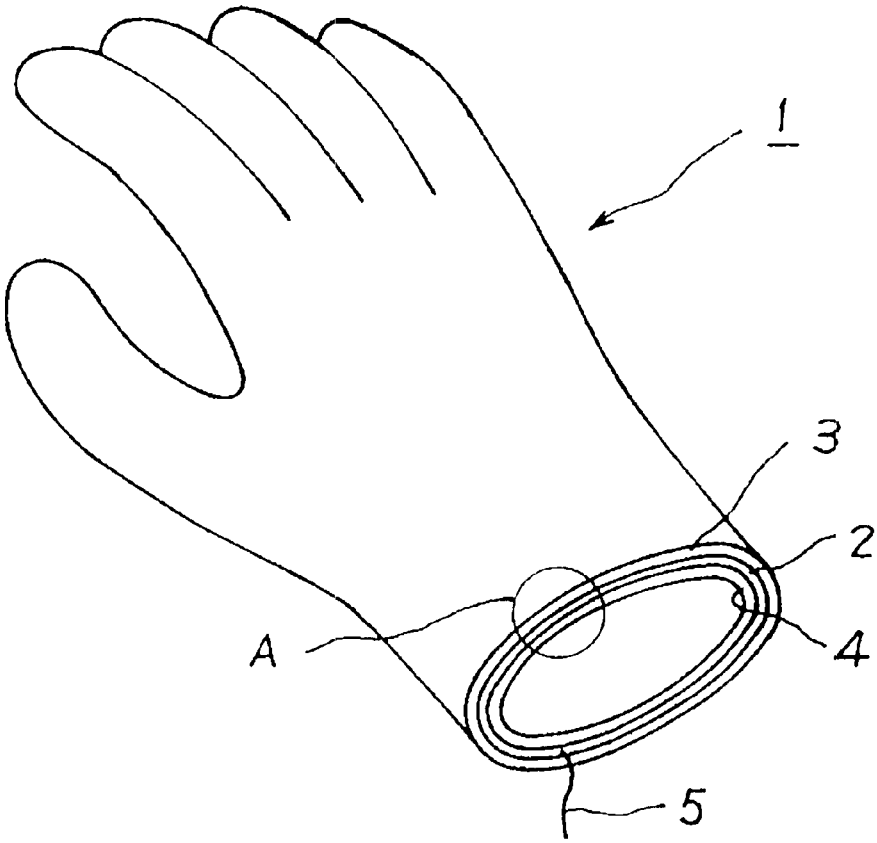
[Figure 2]
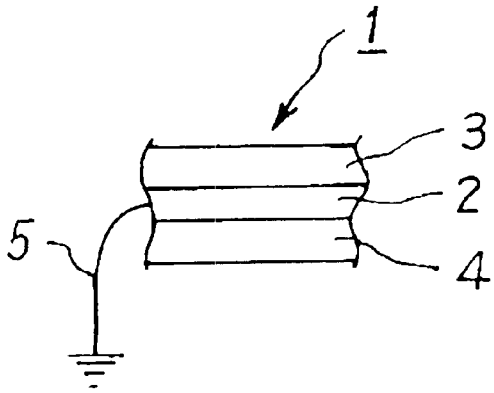

[Figure 3]
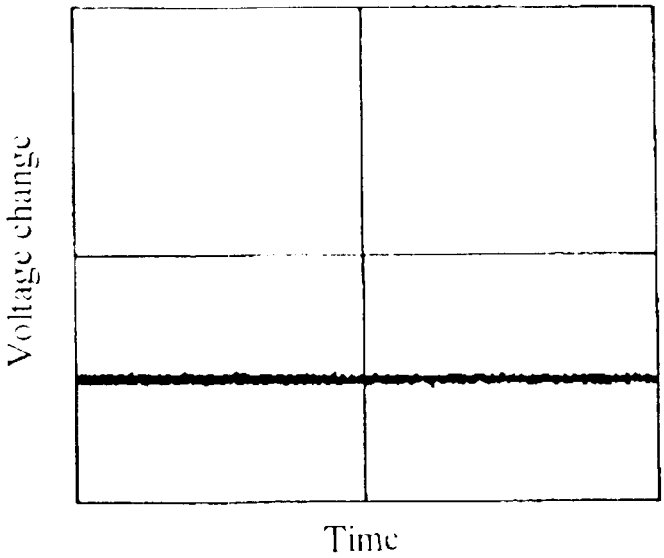
[Figure 4]
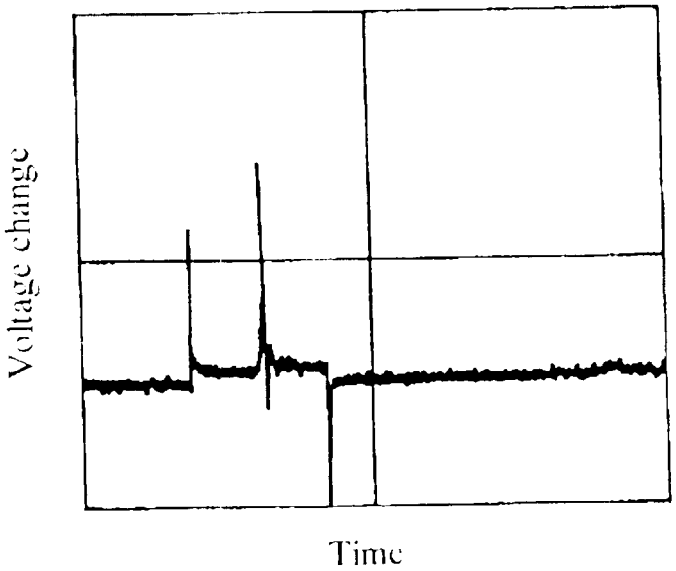

MAGNETIC HEAD HANDLING GLOVE

BACKGROUND OF THE INVENTION

1. Field of the Invention

The present invention relates to a magnetic head handling glove used for handling a magnetic head, particularly an MR (magnetoresistive) or a GMR (giant magnetoresistive) head in a clean room.

2. Description of the Related Art

Conventionally, when components easily damaged by ESD (electrostatic discharge) are produced in clean rooms, the processes are automated so that such components can be produced without allowing them to come into contact with human hands. However, in the case of certain components, such as MR head components or GMR head components, which can easily be damaged by ESD, it has traditionally been difficult to avoid contact with human hands during the production process, since some manufacturing processes require the handling of MR heads or GMR heads by the human hands of an operator, such as when an operator attaches an MR head or head to a suspension using forceps. In such circumstances, a problem can occur if an operator builds up a static charge which is then discharged onto the MR head or GMR head damaging the component.

A prior art solution to this problem is that wrist straps are worn by operators to prevent the buildup of static charges. However, the amount of static charge that can build up on an operator significantly depends upon the skin resistance of individual operators. In the case of operators with dry skin, the wrist strap is not effective due to the high resistance of such operators' skin, so that any slight movements made by an operator will result in increases in the quantity of static charge that is built up on the operator. Thus, wrist straps have not worked with such dry-skinned operators.

Published Unexamined Patent Application No. 63-75179 discloses a technology for preventing a glove from acquiring a static charge by application of an antistatic powder compound. The antistatic powder compound is formed by uniformly dispersing carbon black in vinyl chloride resin and plasticizer, and then coating the surface of a glove with the compound. Although this technology may limit the buildup of static charges, it cannot be used for the purpose of the present invention, namely for handling MR or GMR heads, as it is insufficient especially for preventing electric charge leakage occurring at the fingertips of the glove.

Published Unexamined Patent Application No. 7-189002, although not specifically directed to the prevention of static electrical charges, does disclose a technology for dust prevention and electromagnetic shielding by disclosing a laminated electromagnetic shielding cloth comprising conductive fiber coated with Teflon or urethane on the surface or the reverse surface. However, this technology also cannot be used for the purpose of the present invention, namely for handling MR or GMR heads, since the conductive fiber disclosed in Published Unexamined Patent Application No. 7-189002 is not grounded, and thus, in the instance where a dry-skinned operator's body has built up a static charge, it cannot prevent a glove worn by such an operator from also building up a static charge.

Therefore, the purpose of the present invention is to solve the problems described above by making it possible to prevent ESD and the buildup of unwanted static electric charges, as well as to provide a magnetic head handling glove that is suitable for clean room use.

SUMMARY OF THE INVENTION

In the present invention, a magnetic head handling glove comprises a conductive glove having a first coating layer on an outer surface and a second coating layer on an inner surface of the conductive glove. The first and second coating layers of the present invention are formed, respectively, by coating the outer and inner surfaces of the conductive glove with a dissipative material. Furthermore, in an embodiment of the present invention, the second coating layer of the conductive glove may not be formed, and only a first coating layer of a dissipative material is formed on the outer surface of the conductive glove. In this case, the glove is not directly grounded but is grounded through a high resistive path of about 1 MΩ.

The dissipative materials used in forming the first and second coating layers of the conductive glove are materials that can be used in a clean room. Thus, when a glove of the present invention is used in a clean room, possible contamination from the direct use of the conductive glove may be prevented. Furthermore, in an embodiment of the present invention, the conductive glove is connected to a grounding conductor without any substantial resistance by a wire connecting the conductive glove to an electrical ground. As a result, the accumulation of electrostatic charges on an operator's body and ESD may be prevented.

In a preferred embodiment of the present invention, the sheet resistance of the dissipative material is $10^4$ ohm/sq. to $10^{12}$ ohm/sq. Materials with resistance in this range are between insulators and conductors. Preferably, the dissipative material comprises nitrile rubber or polyurethane. With either material, the glove can be used in clean rooms without acquiring static charge buildup by friction as would an insulator. Furthermore, in an embodiment of the present invention, where only the outer surface is coated with dissipative material, then the conductive glove is grounded through a high resistance of about 1 MΩ.

BRIEF DESCRIPTION OF THE DRAWINGS

FIG. 1 is a perspective view of a magnetic head handling glove of the present invention;

FIG. 2 is a cross-sectional view of area A of the glove shown in FIG. 1;

FIG. 3 is a graph showing the voltage change determined when a magnetic head handling glove of the present invention is used; and FIG. 4 is a graph showing the voltage change determined when a conventional glove for clean rooms is used.

DETAILED DESCRIPTION OF THE PREFERRED EMBODIMENT

FIG. 1 shows the structure of a magnetic head handling glove of the present invention, and FIG. 2 shows details of area A of the glove of FIG. 1. In the embodiment shown in FIGS. 1 and 2, the magnetic head handling glove I has a first coating layer 3 and a second coating layer 4 formed by coating the outer and inner surfaces, respectively, of a conductive glove 2 with dissipative material. Furthermore, in the embodiment shown in FIGS. 1 and 2, wire 5 is directly connected to conductive glove 2 and provides a low resistance path to an electrical ground. Further, though both the outer surface and the inner surface of the conductive glove are coated with dissipative material in the embodiment shown in FIGS. 1 and 2, in an alternative embodiment of the present invention, only the outer surface of the conductive glove is coated with a dissipative material and the glove is not grounded directly but with high resistance (about 1 MΩ).

Any conventionally known conductive glove may be used as the conductive glove 2. As the dissipative material forming the coating layers 3 and 4, it is preferable to use a material with sheet resistance between $10^4$ ohm/sq. to $10^{12}$ ohm/sq. The dissipative material is preferably either nitrile rubber or polyurethane. The wire 5 is formed of any electrically conductive material that connects at a reliable ground and is only limited in as far as it is conductive and can be grounded without fail.

In the magnetic head handling glove 1 of the present invention, by coating a conductive glove 2 with a prescribed dissipative material, namely a material for clean room use, sufficient prevention of static charge buildup can be attained through grounded conductive glove 2. In addition, possible contamination from use of a conductive glove 2 may be prevented by first and second coating layers 3 and 4. Thus, by using the magnetic head handling glove 1 of the present invention, even under the circumstance where a wrist strap worn by an operator is ineffective such as when an operator has dry skin, the probability of causing damage to MR heads and GMR heads is significantly reduced.

In a comparison test, a magnetic head handling glove of the present invention and a conventional clean room glove (comprising dissipative material alone) were individually tested. Each glove was worn on a hand, and the change in voltage at the tip of a forceps grabbed by the hand was measured. FIG. 3 shows voltage change versus time data obtained when the magnetic head handling glove of the present invention was worn. FIG. 4 shows voltage change versus time data obtained when a conventional clean room glove was worn. Comparison of FIGS. 3 and 4 reveals that in the case where a magnetic head handling glove of the present invention was worn, the voltage change at the tip of the forceps did not occur, whereas large voltage changes were observed in the case of the conventional glove. Thus, even when the operator has generated a static charge, the electric field is shielded or the charge is bled off (dissipated) due to having the conductive glove 2 inside the glove 1.

Therefore, an advantage of the present invention is that with the dissipative first and second coating layers 3, 4, or, alternatively, when only the first coating layer 3 is used, possible contamination from direct use of the conductive glove in a clean room may be prevented. A further advantage of the present invention is that the conductive glove 2 is directly grounded and can prevent or greatly reduce ESD damage caused by an operator prone to having static electricity.

We claim:

1. A magnetic head handling glove, comprising:

a conductive glove having an inner surface and an outer surface, wherein at least the outer surface of said conductive glove is coated with a dissipative material of nitrile rubber or polyurethane; and said conductive glove being grounded with low resistance.

2. The magnetic head handling glove according to claim 1, wherein said dissipative material has a sheet resistance in the range of $10^4$ ohm/sq. to $10^{12}$ ohm/sq.

3. The magnetic head handling glove according to claim 1, wherein said conductive glove is grounded with high resistance in the case where only the outer surface is coated with dissipative material.

4. A magnetic head handling glove, comprising:

a conductive glove having an inner surface and an outer surface, wherein at least the outer surface of said conductive glove is coated with a dissipative material of nitrile rubber or polyurethane; and said conductive glove being grounded directly.

5. The magnetic head handling glove according to claim 4, wherein said dissipative material has a sheet resistance in the range of $10^4$ ohm/sq. to $10^{12}$ ohm/sq.

6. The magnetic head handling glove according to claim 4, wherein said conductive glove is grounded with high resistance in the case where only the outer surface is coated with dissipative material.

7. A magnetic head handling glove, comprising:

a conductive glove having an inner surface and an outer surface and said conductive glove being grounded with low resistance;

a first coating layer of a dissipative material in contact with the outer surface of said conductive glove; and a second coating layer of a dissipative material in contact with the inner surface of said conductive glove.

8. The magnetic head handling glove according to claim 7, wherein said dissipative material has a sheet resistance in the range of $10^4$ ohm/sq. to $10^{12}$ ohm/sq.

9. The magnetic head handling glove according to claim 7, wherein said dissipative material of said first coating layer is nitrile rubber or polyurethane.

10. The magnetic head handling glove according to claim 7, wherein said dissipative material of said second coating layer is nitrile rubber or polyurethane.

11. The magnetic head handling glove according to claim 7, wherein said conductive glove is grounded with high resistance in the case where only the outer surface is coated with dissipative material.

12. A magnetic head handling glove, comprising:

a conductive glove having an inner surface and an outer surface, said conductive glove being grounded directly;

a first coating layer of a dissipative material in contact with the outer surface of said conductive glove; and a second coating layer of a dissipative material in contact with the inner surface of said conductive glove.

13. The magnetic head handling glove according to claim 12, wherein said dissipative material has a sheet resistance in the range of $10^4$ ohm/sq. to $10^{12}$ ohm/sq.

14. The magnetic head handling glove according to claim 12, wherein said dissipative material of said first coating layer is nitrile rubber or polyurethane.

15. The magnetic head handling glove according to claim 12, wherein said dissipative material of said second coating layer is nitrile rubber or polyurethane.

16. The magnetic head handling glove according to claim 12, wherein said conductive glove is grounded with high resistance in the case where only the outer surface is coated with dissipative material.

17. The magnetic head handling glove according to claim 12, wherein the conductive glove is grounded directly by a wire connecting the conductive glove to an electrical ground.

18. A magnetic head handling glove, comprising:

a conductive glove having an inner surface and an outer surface, wherein at least the outer surface of said conductive glove is coated with a dissipative material of nitrile rubber or polyurethane; and said conductive glove having a grounding wire electrically connected to said conductive glove.

19. The magnetic head handling glove according to claim 18, wherein said dissipative material has a sheet resistance in the range of $10^4$ ohm/sq. to $10^{12}$ ohm/sq.

20. The magnetic head handling glove according to claim 18, wherein said conductive glove is grounded with high resistance in the case where only the outer surface is coated with dissipative material.

* * * * *